United States Patent [19]

Cronan et al.

[11] 4,391,347

[45] Jul. 5, 1983

[54] SAFETY DEVICE FOR LADDER ACCESS OPENING TO AN ELEVATED PLATFORM

[75] Inventors: John M. Cronan, Baton Rouge; Joseph M. Haynes, Baker; Darrell D. Jones, Brusly, all of La.

[73] Assignee: The Dow Chemical Company, Midland, Mich.

[21] Appl. No.: 264,878

[22] Filed: May 18, 1981

[51] Int. Cl.[3] ..... E04G 9/10; E04G 5/00

[52] U.S. Cl. ..... 182/113; 182/115

[58] Field of Search ..... 182/113, 152, 116, 115

[56] References Cited

U.S. PATENT DOCUMENTS

| | | | |
|---|---|---|---|
| 1,364,843 | 1/1921 | Martin | 105/358 |
| 2,593,386 | 4/1952 | Dirks | 182/152 |
| 3,084,638 | 4/1963 | Allegrette | 105/358 |
| 3,463,265 | 8/1969 | Clover | 182/152 |
| 3,708,198 | 1/1973 | Coons | 182/115 |
| 3,752,261 | 8/1973 | Bushnell | 182/17 |
| 3,752,262 | 8/1973 | Helms | 182/113 |
| 4,185,716 | 1/1980 | Rinehart | 182/2 |

*Primary Examiner*—Reinaldo P. Machado
*Attorney, Agent, or Firm*—A. J. Young

[57] ABSTRACT

A safety device for that portion of an elevated platform, including a horizontal guard railing, to which an open access ladder is attached. The safety device comprises an elongated, rigid member adapted to form an extension of the horizontal portion of the guard railing; and means for securely connecting the elongated member to the guard railing on both sides of the ladder access opening to the platform, thereby providing an extension of the horizontal portion of the guard railing which includes the portion of the platform above the platform access opening of the ladder.

2 Claims, 2 Drawing Figures

SAFETY DEVICE FOR LADDER ACCESS OPENING TO AN ELEVATED PLATFORM

BACKGROUND OF THE INVENTION

This invention relates to a safety device for personnel working on elevated platforms such as those associated with storage tanks or loading stations for railroad tank cars or tank trucks. More particularly, the invention relates to a device which locks onto the platform railing, thereby providing a protective railing for an otherwise unguarded ladder access opening of the platform.

It is standard practice to provide guard-railing around an elevated platform such as for the railroad tank car described in U.S. Pat. No. 3,084,638 to Allegrette. Such railing, however, does not include the access opening immediately adjoining the ladders attached to the platform. This area is therefore particularly hazardous for personnel working on the platform, since accidental falls can result in serious injuries to such personnel. Attempts to solve this problem have apparently been limited to attaching a chain to the railing on both sides of the ladders, thus "chaining off" the area of the platform immediately above the ladders.

SUMMARY

At the present time elevated platforms are normally provided with a guard railing around the platform which does not include the area immediately above the platform ladders. At the points where the ladders are attached to the platform, the platform railing usually curves vertically downward to form a support post. The lower end of this support post is fastened to the platform or to the ladder which results in the area immediately above the ladder being open and unprotected by the guard railing.

In general, this invention provides a safety device for that portion of an elevated platform, including a horizontal guard railing, to which an open access ladder is attached, said device comprising an elongated, rigid member adapted to form an extension of the horizontal portion of the guard railing; and means for securely connecting the elongated member to the guard railing on both sides of the ladder at the points where the horizontal railing and a vertical support post for the railing converge together or where the railing bends down to attach to the platform, thereby providing an extension of the horizontal portion of the guard railing which includes the portion of the platform above the platform access opening of the ladder.

It is an object of this invention to provide a device which will protect personnel from falls while using an elevated platform. It is a specific object of the invention to provide a device which will protect personnel from falls while using the area of the platform in the vicinity of a ladder attached thereto. A further object of the invention is to provide a safety device for an elevated platform, which device is portable, adaptable to most platforms, easily and securely locked into position while in use, and easily unlocked when no longer required. Other objects of the present invention will be apparent to those skilled in the art from the more detailed description which follows.

DESCRIPTION OF THE PREFERRED EMBODIMENTS

The following description illustrates the manner in which the principles of the present invention are applied, but is not to be construed as in any sense limiting the scope of the invention.

Figure 1:
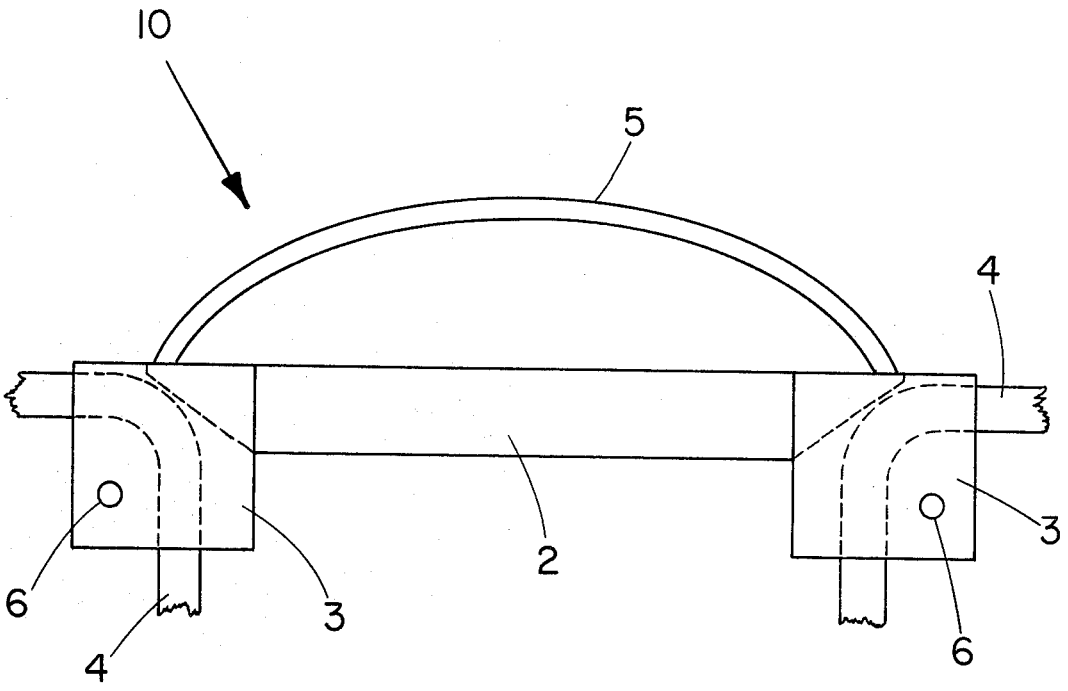
FIG. 1 is a front view of a safety device made in accordance with the present invention.
Figure 2:
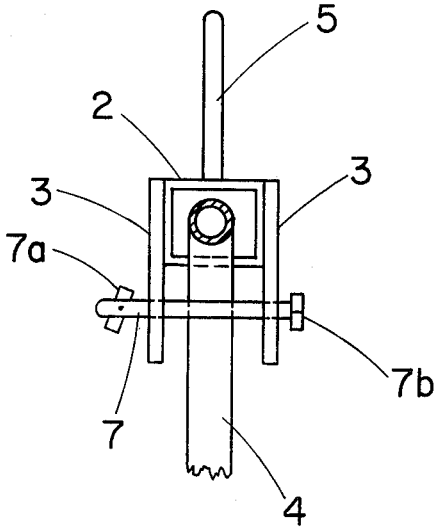
FIG. 2 is an end view of the safety device shown in FIG. 1.

More specifically, reference is made to FIGS. 1 and 2 wherein a safety device 10 for the ladder access opening to an elevated platform is illustrated. Plates 3, in pairs, are securely fastened to each end of the elongated, rigid member 2 as shown in FIGS. 1 and 2. Plates 3 of each pair of plates include holes 6 which are aligned and adapted to receive pin 7. Pin 7 includes a head *7b* and locking device *7a* to prevent pin 7 from accidentally coming out of holes 6 during use of the safety device 10. The locking device *7a* is preferably a wedge which is pivotally-mounted in a slot near the end of pin 7. Pin 7 is preferably provided with a retaining means, not shown, such as a chain, to secure pin 7 to the safety device 10 thereby preventing its loss or misplacement, and to ensure its availability at all times.

The safety device 10 is also preferably provided with a handle 5 that is securely fastened to the top of the elongated member 2 as shown in FIGS. 1 and 2. The handle 5 not only provides convenient portability for the safety device 10, but also acts as a secondary barrier, in addition to member 2, for the prevention of falls by personnel working on the platform. The handle 5 also acts as a means of attracting attention and signalling that the platform is in use.

The preferred safety device 10 thus comprises means for connecting the elongated member 2 to the platform guard railing 4 which includes a pair of plates 3 rigidly fastened to each end of, and projecting beyond each end of, the elongated member 2 and means (pin 7) for securely connecting each pair of plates 3 at each end of member 2 together below the platform guard railing 4 at the points where the horizontal sections of railing 4 bend down to attach to the platform or where the vertical support posts converge together with the horizontal section of the railing 4, thereby locking the ends of the safety device 10 to the railing 4 above the platform access opening of the platform ladder. The safety device 10 may be constructed of any structural material with satisfactory strength properties such as a metal, preferably an aluminum alloy; or a plastic, preferably a fiberglass reinforced thermoset polymer. The safety device 10 is preferably fabricated by welding or bolting the various parts together in the case where a metal is used, or by bolting or gluing the parts together where a reinforced plastic is used.

While certain representative embodiments and details have been shown for the purpose of illustrating this invention, it will be apparent to those skilled in the art that various changes and modifications can be made without departing from the spirit and scope of the invention.

What is claimed is:

1. A safety device for that portion of an elevated platform, including a horizontal guard railing, to which an open access ladder is attached, comprising an elongated, rigid member adapted to form an extension of the horizontal portion of the guard railing, and means for connecting the elongated member to the platform railing including a pair of plates rigidly fastened to each end of the elongated member, and means for securely connecting each pair of plates at each end of the elongated member together below the guard railing at a point where the horizontal sections of the railing bend down to attach to the platform or where the vertical support posts converge together with the horizontal section of the railing, whereby the ends of the safety device can be locked to the railing above and on each side of the platform access opening of the platform ladder.

2. The safety device of claim 1 wherein the means for securely connecting each pair of plates at each end of the elongated member below the platform railing are pins extending through each pair of plates.

* * * * *